United States Patent [19]

Nemec, Jr.

[11] 4,123,925

[45] Nov. 7, 1978

[54] PUNCH-THRU LOCK ASSEMBLY

[75] Inventor: Joseph F. Nemec, Jr., Southington, Conn.

[73] Assignee: Federal, Inc., Southington, Conn.

[21] Appl. No.: 844,537

[22] Filed: Oct. 25, 1977

[51] Int. Cl.[2] ..... E05B 15/16

[52] U.S. Cl. ..... 70/329; 70/333 R; 70/422

[58] Field of Search ..... 70/1.5, 329, 333 R, 70/422

[56] References Cited

U.S. PATENT DOCUMENTS

| | | | |
|---|---|---|---|
| 3,104,538 | 9/1963 | Roberts | 70/333 R |
| 3,111,022 | 11/1963 | Maynard | 70/1.5 |
| 3,702,551 | 11/1972 | Blizard | 70/209 |
| 3,719,064 | 3/1973 | Potzick | 70/329 |

*Primary Examiner*—Robert L. Wolfe

[57] ABSTRACT

A punch-thru lock assembly for use on safes and vaults and effective to prevent the forceful removal of the cover from the lock so as to preclude unauthorized access from being gained to the inside mechanisms of the lock while the door of the safe or vault is in its closed and locked position. The punch-thru lock assembly includes a spindle having a cam wheel secured thereto by means of a key whereby the cam wheel rotates in unison with the spindle but the key is capable of being defeated so as to free the cam wheel from engagement with the spindle. The lock assembly also includes a cover which is intentionally provided with a weakened portion through which an end of the spindle may be made to pass, when the latter is forcefully removed from the lock assembly being pushed inwardly.

15 Claims, 1 Drawing Figure

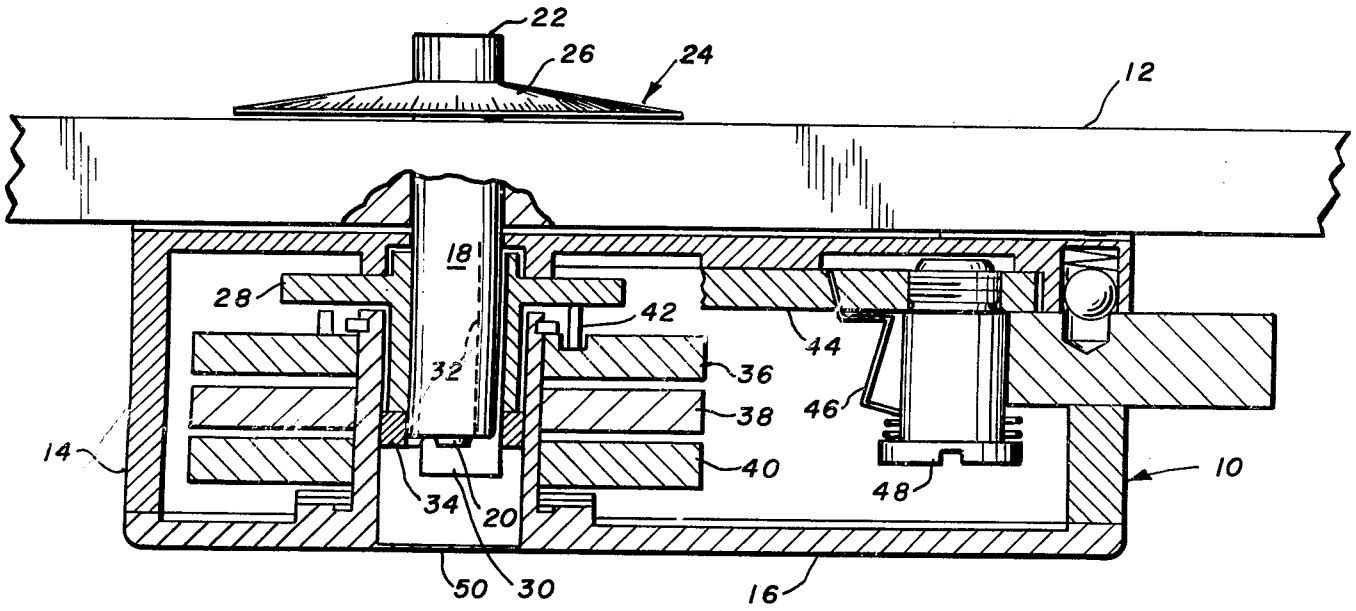
10
12
16
14
18
20
22
24
26
28
30
32
34
36
38
40
42
44
46
48
50

PUNCH-THRU LOCK ASSEMBLY

BACKGROUND OF THE INVENTION (1) Field of the Invention

The present invention relates to combination locks employed on safes and vaults, and more particularly to an improvement in lock assemblies of the punch-thru type which are intended to be effective to prevent unauthorized access from being gained to the interior of the safe or vault on which the punch-thru lock assembly is employed.

(2) Description of the Prior Art

It has long been conventional practice utilize locks for purposes of regulating access to the interior of safes and vaults. One of the most common forms of locks, which is employed for this purpose, is the so-called combination lock. The latter embodies a combination dial having numbers provided thereon which, when manipulated in accordance with a pre-established sequence, causes the tumblers housed in the enclosure case of the lock to become aligned in a set pattern whereby the bolt of the lock is moved from its locking to its unlocking position thereby permitting the door of the safe or vault to be opened.

A number of different approaches have been tried down through the years in an attempt to improve the security which is afforded through the utilization of a lock on a safe or vault. Namely, a variety of methods have been devised for use with locks in an effort to render them virtually tamperproof. Notwithstanding these efforts, surreptitious entry to safes and vaults remains a serious problem which all lock manufacturers are continuously called upon to face. In this regard, quite often it is found that surreptitious entry to a safe or vault has been gained as a consequence of the lock having been defeated in some fashion.

For example, it is well-known that there exist a significant number of individuals who possess skills which make them adept at gaining access to the interior of safes or vaults by surreptitiously opening the locks with which the latter are provided. These individuals commonly employ for this purpose a technique which depends for its utilization on the application of the human senses of hearing and/or touch. More specifically, the technique which these individuals employ in this regard involves the manipulation of the combination dial of the lock in an effort to determine, be listening for the noises and/or by sensing the vibrations which are created when the tumblers of the lock are moved in response to the rotation of the combination dial, when the tumblers have become aligned in the position thereof which corresponds to the open condition of the lock. Thus, through the successful application of the aforedescribed technique such an individual is able to effect the defeat of the lock without destroying the latter or for that matter even causing any measurable damage thereto. Concomitantly, a breach is effected of the security which is designed to be provided as a consequence of the employment of the lock; namely, the paramount reason why the lock is being used at all is to provide the desired degree of security, i.e., controlled access to the interior of the safe or vault with which the lock is used. Absent the ability of the lock to provide this degree of security, very little other justification would remain which would warrant the placement of a lock on a safe or vault. It is for this reason, therefore, that all lock manufacturers must be concerned with the matter of the relative degree of ease with which any lock manufactured thereby is capable of being defeated.

One approach which some lock manufacturers have adopted in the past to effect a lessening of the likelihood that their locks could be successfully defeated through the use of the technique described in the preceding paragraph, which is dependent on its usage for a sensing of sound and/or touch, is to employ means operable to dampen the sounds that are produced when the tumblers are moved in response to rotation of the combination dial of the lock. More specifically, the object in this instance is to provide a lock which embodies means operable such that variations in sound and feel are dampened, and moreover are prevented from being usefully transmitted to the individual manipulating the combination dial of the lock. By way of illustration, one form of such a lock embodying dampening means of the aforedescribed type can be found described and illustrated in U.S. Pat. No. 3,106,083 to 17 Maynard.

Another approach which some lock manufacturers have taken to combat the susceptibility of their locks being defeated through the technique of listening to noises and/or feeling for vibration as the tumblers move is to equip the lock with time delay means. The objective here is to provide the lock with a time delay mechanism, which is operative to permit the lock to be opened only after a pre-established time period has elapsed following the setting of the tumblers of the lock for opening. One such lock equipped with a form of time delay means comprises the subject matter of U.S. Pat. No. 3,702,551 to Blizard.

In addition to the technique described previously herein, which relies on an individual's ability to detect through sound and/or touch when the tumblers of the lock have become aligned in their open condition, there exists another technique for surreptitiously opening a lock which also is frequently employed by those seeking to gain unauthorized access to the interior of a safe or vault. Reference is had here to the technique of punching out the spindle with which the combination dial as well as the tumblers of the lock are cooperatively associated. Namely, what is done is to force the spindle out through the back of the lock, whereby the tumblers of the lock as well as the cover of the lock case are forced from, i.e., disassociated from the lock. When this occurs, the lock is rendered inoperative, such that the lock is no longer effective to perform its locking function. Thus, the door of the safe or vault can now be opened so as to enable an unauthorized person to remove the contents of the safe or vault at will. A need has therefore been demonstrated to provide a lock embodying means which is effective to overcome the ability of the lock to be mechanically defeated by removing the dial and punching-thru the spindle.

SUMMARY OF THE INVENTION

In accordance with a preferred form of the invention there is provided a novel and improved lock assembly which is operative to prevent the forceful removal of the cover from the lock so as to preclude unauthorized access from being gained to the inside mechanisms of the lock while the door of the safe or vault is in its closed and locked position. A lock in accordance with the invention includes a lock case having a cover suitably affixed thereto. A spindle is supported within the lock case so as to have one end thereof positioned in the interior of the lock case and the other end thereof projecting downwardly of the lock case so as to be exposed to view. The exposed end of the spindle has a combination dial suitably affixed thereto for rotation therewith. Rotation of the combination dial is transmitted to the spindle to effect the rotation of the latter also. The spindle has a cam wheel affixed thereto intermediate the ends thereof. A spindle key is employed to secure the cam wheel to the spindle whereby the cam wheel rotates in unison with the spindle. The spindle key is capable of being defeated so as to free the cam wheel from engagement with the spindle. The cam wheel has cooperatively associated therewith tumbler means and lock bolt means operable to determine the locked and unlocked conditions of the lock. The cover of the lock case is intentionally provided with a weakened portion axially aligned with the spindle. Assuming that the punch-thru lock assembly is in its lock condition, the effect of the forceful removal of the spindle through applying an axial driving force thereto is to cause the defeat of the spindle key with the result that the cam wheel, the tumbler means and the lock bolt means remain positioned within the interior of the lock case and the lock remains in its locked condition.

It is therefore an object of the present invention to provide a novel and improved lock for use on safes and vaults which is effective to prevent unauthorized access to be gained to the interior of the safe or vault.

It is another object of the present invention to provide such a lock which embodies punch-thru means which is operative to prevent the defeat of the lock.

A further object of the present invention is to provide such a lock with punch-thru means which is operative such that should the spindle of the lock be forced therefrom the lock nevertheless still remains operative to perform its locking function.

A still further object of the present invention is to provide such a lock with punch-thru means which is operative to prevent the tumblers from being forced from the lock in an effort to effect the defeat of the lock.

Yet another object of the present invention is to provide such a lock with punch-thru means which is operative to prevent the cover from becoming disassociated from the lock case in an effort to effect the defeat of the lock.

Yet still another object of the present invention is to provide such a lock with punch-thru means which is compatible for use with most existing types of safes and vaults.

Yet a final object of the present invention is to provide such a lock with punch-thru means which is relatively simple in construction, which is easy to employ, and which is relatively inexpensive to manufacture.

BRIEF DESCRIPTION OF THE DRAWING

The FIGURE is a sectional view of a punch-thru lock assembly constructed in accordance with a preferred embodiment of the present invention and illustrated in mounted relation to the door of a safe.

DESCRIPTION OF A PREFERRED EMBODIMENT

Referring now to the FIGURE of the drawing, there is illustrated therein a punch-thru lock assembly, generally designated by reference numeral 10. The punch-thru lock assembly 10 is typically mounted on the door 12 of a safe or vault by means of any conventional form of fastener.

Punch-thru lock 10 includes a lock case 14 in which the internal working mechanisms of a lock are suitably retained, in a manner which will be described subsequently. The case 14 is substantially rectangular in configuration; case 14 having a plurality of side walls and a first closed end wall which are suitable joined together so as to preferably form an integral structure. A removable punch-thru lock case cover 16 effects the closing of the open second end of case 14. The lock case cover 16 is secured to the lock case 14 through the use of any suitable type of fastener.

The punch-thru lock 10 further includes a spindle 18 which has a first end 20 thereof supported for rotation within the interior of the lock case 14. The second end 22 of spindle 18 projects outwardly through lock case 14 and is of sufficient length so as to be capable of projecting beyond the outer surface of door 12. The exposed second end 22 of the spindle 18 has a combination dial 24 secured thereon in the conventional manner. The combination dial 24, which bears numerals (not shown) and indicia 26 thereon, is designed to be grasped and manipulated in a well-known manner for purposes of effecting the opening of the lock 10 thereby permitting the door 12 of the safe or vault to also be opened. To this end, the combination dial 24 is secured to the spindle 18 in a manner whereby rotation of the combination dial 24 is transmitted to the spindle 18.

A cam wheel 28 is mounted on spindle 18 to intermediate the ends thereof. Cam wheel 28 is defeatedly secured to the spindle 18 through the use of a spindle key 30. The spindle key 30 is received in a longitudinally extending slot 32 formed in the circumference of spindle 18. In addition, the spindle key extends into a slot, not shown, in the hollow interior of the cam wheel 28; cam wheel 28 being provided with a hollow interior suitably dimensioned so as to permit the spindle 18 to be received therewithin with a sliding fit and the spindle key receiving slot being formed in a side wall of the hollow interior of the cam wheel 28. Thus, the spindle key 30 is operative to secure the cam wheel 28 to the spindle 18 whereby the cam wheel 28 will rotate in unison with the spindle 18 as long as the spindle key 30 remains positioned in the slot 32 of the spindle 18 and the aligned slot provided therefor in the cam wheel 28.

Spindle 18 preferably has a spindle retainer 34 cooperatively associated therewith. The spindle retainer 34 is utilized in the course of mounting the cam wheel 28 on the spindle 18 and then positioning the latter in the lock case 14. Spindle retainer 34 is preferably threadedly engaged on the end 20 of the spindle 18 after the cam wheel 28 has been positioned on the spindle 18 but before the spindle key 30 has been inserted in the slot 32 of the spindle 18.

The remainder of the internal mechanism of the punch-thru lock assembly 10, which is illustrated in the drawing and which remains to be described, consists of the actual locking mechanism of the lock and is essentially of conventional construction. The locking mechanism may take the form of any of the conventional structures commonly employed for this purpose and thus it is not deemed necessary for purposes of obtaining an understanding of the present invention for a detailed description of this locking mechanism to be set forth therein. Suffice it to say, the locking mechanism includes a multiplicity of tumblers, which in accordance with the illustrated embodiment of the invention total three in number, i.e., tumblers 36, 38 and 40. Obviously a greater or lesser number of tumblers could be employed in the punch-thru lock assembly 10 without departing from the essence of the invention. The tumblers 36, 38 and 40, in a manner well-known to those skilled in the art, each carry a gate which is designed to cooperate with a fence 42. The fence 42, in turn, is cooperatively associated in conventional fashion with the lock bolt 44. The lock bolt 44 is cooperatively associated with the cam wheel 28 whereby movement of the lock bolt 44 can be effected under the control of the cam wheel 28. More specifically, a portion of the lock bolt 44, under the bias of spring 46, is drivingly engaged with the cam wheel 28 and the tumblers 36, 38 and 40 whereby through the rotation of the combination dial 24 the lock bolt 44 can be moved from its extened locking position to its withdrawn unlocking position. In accordance with the preferred embodiment of the invention, one end of the spring 46 engages a portion of the lock bolt 44, while the other end surrounds a portion of a threaded fastener 48. The latter is threadedly engaged in the lock bolt 44 and is operative to effect the regulation of the spring force being exerted by the spring 46. For purposes of obtaining a better understanding of the mode of operation of the lock bolt 44, reference may be had, for example, to the two issued U.S. Patents to which reference has previously been made herein.

Completing the description of the punch-thru lock assembly 10 constructed in accordance with the disclosed embodiment of the present invention, the lock case cover 16 is intentionally provided with a weakened portion 50. The weakened portion 50 is located in the case cover 16, so as to be axially aligned with the spindle 18. Consequently, should an attempt be made to gain surreptitious entry to the safe or vault equipped with the punch-thru lock assembly 10 of the present invention by removing the combination dial 24 from the spindle 18 and thereafter applying a force of suitable strength to the end 22 of the spindle 18 to cause the latter to be driven into the lock case 14, the end 20 of the spindle 18 operates to punch a hole through the weakened portion 50 provided for this reason in the lock case cover 16. The breaking out of a portion of cover 16 permits the spindle 18 to move longitudinally relative to the lock case 14 leaving the remainder of the lock assembly 10 intact; i.e., the spindle will also move longitudinally relative to the internal mechanisms including the cam wheel 28 and the tumblers 36, 38 and 40.

In conventional lock assemblies the cam wheel is threaded directly on to the spindle. In the punch-thru lock assembly 10 constructed in accordance with the present invention the cam wheel 28 is detachably mounted on the spindle 18 through the use of the spindle key 30. Consequently, in lock assemblies of conventional construction, when the spindle thereof is driven into the lock case, the cam wheel is carried therewith causing the tumblers of the lock as well as the lock case cover to be forcibly removed from the lock. By way of contrast, the spindle 18 of a lock in accordance with the present invention will slide through the cam wheel 28, striking the weakened portion 50 of cover 16 and pass therethrough. The remainder of the internal mechanism of the lock assembly 10, including the cam wheel 28 and the tumblers 36, 38 and 40, remain intact in their respective original positions.

The weakened portions 50 of the lock cover case 16 is preferably created by milling the inside surface of cover 16 to within 0.015 inches of breaking through. In addition, the weakened portion 50 is preferably formed so as to be equivalent in diameter to the inside diameter of the cam wheel 28 so as to preclude use of a punch 50 to force the cam wheel 28 out of position after forcible removal of spindle 18. It should be noted that the disengagement of the cam wheel 28 from the spindle 18 occurs from the fact that, as the spindle 18 is driven into the lock case 14, the spindle retainer 34 functions to cause the spindle key 30 to move with the spindle 18. Thus, the spindle key 30 remains positioned within the slot of the spindle 18 and slides out of the slot in the side wall of the hollow interior of the cam wheel 28.

For purposes of clarification, the added steps involved in the assembly of the spindle 18, the cam wheel 28, the spindle key 30 and the spindle retainer 34 are as follows. First the proper length of the spindle 18 is determined by inserting the spindle 18 into the cam wheel 28 until the combination dial 24 rests against the outer surface of the door 12 of the safe or vault. Then an allowance of ¼ inch is made from the shoulder of the cam wheel 28, with the spindle 18 then being removed and the excess length of the spindle 18 thereafter being cut off. The spindle 18 is then placed into the cam wheel 28, and the spindle retainer 34 is screwed on to the end 22 of the spindle 18 until the spindle retainer 34 is snug. Thereafter, the spindle retainer 34 is backed off until the internal slot in the cam wheel 28 is aligned with the slot 32 of the spindle 18 and a slot provided in the spindle retainer 34. The spindle key 30 is then inserted into the three aligned slots. The assembly of the cam wheel 28, and the spindle retainer 34 on the spindle 18 is thereby effected with the spindle key 30.

Thus, in accordance with the present invention, there has been provided a novel and improved lock for use on safes and vaults which is effective to prevent unauthorized access to be gained to the interior of the safe or vault. The lock of the present invention embodies punch-thru means which is operative to prevent the defeat of the lock. In accordance with a preferred form of the invention, the lock is operative such that should the spindle of the lock be forced therefrom the lock nevertheless still remains operative to perform its locking function. The lock of the present invention is thus operative to prevent the tumblers from being forced from the lock in an effort to effect the defeat of the lock. Moreover, a lock in accord with the present invention is operative to prevent the cover from becoming disassociated from the lock case in an effort to effect the defeat of the lock. In addition, the lock of the present invention is compatible for use with most existing types of safes and vaults. Finally, in accord with the present invention a lock has been provided which is relatively simple in construction, easy to employ, and relatively inexpensive to provide.

While only one embodiment of the invention has been shown, it will be appreciated that modifications thereof, some of which have been noted in the preceding description, may readily be made by those skilled in the art. Accordingly, it will be understood that the appended claims are intended to cover the modifications specifically referred to herein as well as all other modifications which fall within the true spirit and scope of the invention.

What is claimed is:

1. A lock assembly comprising:

housing means, said housing means having an access opening in at least one end thereof;

spindle means supported within said housing means for rotation relative thereto, said spindle means having an axis and a first end located within said housing means, the second end said spindle means projecting outwardly of said housing means so as to be exposed to view;

cam wheel means supported on said spindle means intermediate the ends thereof;

spindle key means detachably securing said cam wheel means to said spindle means whereby rotation of said spindle means is transmitted therethrough to said cam wheel means to cause said cam wheel means to rotate in unison with said spindle means, said key means permitting axial motion of said spindle means relative to said cam wheel means;

tumbler means cooperatively associated with said cam wheel means, said tumbler means being movable in response to rotation of said cam wheel means between a first position corresponding to the locked condition of the lock assembly and a second position corresponding to the unlocked condition of the lock assembly;

lock bolt means cooperatively associated with said cam wheel means and said tumbler means, said lock bolt means being movable between a first position when said tumbler means is in said first position thereof wherein said lock bolt means is operative to effect the establishment of the locked condition of the lock assembly and a second position when said tumbler means is in said second position thereof wherein said lock bolt means is operative to effect the establishment of the unlocked condition of the lock assembly; and cover means secured to said housing so as to at least in part cover said access opening, said cover means having a weakened portion axially aligned with said spindle means, said spindle means first end breaking through said weakened portion when said spindle means is forcibly driven axially into housing means.

2. A lock assembly as defined in claim 1 further comprising:

combination dial means supported on said second end of said spindle means so as to be available for grasping and rotating thereby to impart rotation therethrough to said spindle means.

3. A lock assembly as defined in claim 1 further comprising:

spindle retainer means fastened on said first end of said spindle means, said spindle retainer means including a spindle key means receiving slot, said spindle retainer means being operative to effect the disassociation of said spindle key means from said cam wheel means and thereby from said spindle means when axial motion is imparted to said spindle means.

4. A lock assembly as defined in claim 1 wherein said housing means comprises:

a substantially rectangular enclosure formed by the joining together of a multiplicity of side walls and an end wall to create an integral structure.

5. A lock assembly as defined in claim 1 wherein said spindle means comprises:

an elongated spindle having a longitudinally extending slot formed in a circumference thereof for receiving therein said spindle key means in sliding relation thereto.

6. A lock assembly as defined in claim 1 wherein said cam wheel means comprises:

a cam wheel having a hollow interior and slot means formed in the side wall of said hollow interior for receiving said spindle key means therein with a sliding fit.

7. A lock assembly as defined in claim 1 wherein said spindle key means comprises:

an elongated key member engageable jointly with said cam wheel means and said spindle means.

8. A lock assembly as defined in claim 1 wherein said cover means comprises:

a cover fastened to said housing means, said weakened portion of said cover being formed by milling away the surface of a section of said cover.

9. A lock assembly as defined in claim 5 wherein said cam wheel means comprises:

a cam wheel having a hollow interior and slot means formed in the side wall of said hollow interior for receiving said spindle key means therein with a sliding fit.

10. A lock assembly as defined in claim 9 wherein said spindle key means comprises:

an elongated key member engageable jointly with said cam wheel means and said spindle means.

11. A lock assembly as defined in claim 10 further comprising:

spindle retainer means fastened on said first end of said spindle means, said spindle retainer means including a spindle key means receiving slot, said spindle retainer means being operative to effect the disassociation of said spindle key means from said cam wheel means and thereby from said spindle means when axial motion is imparted to said spindle means.

12. A lock assembly as defined in claim 11 wherein said cover means comrises:

a cover fastened to said housing means, said weakened portion of said cover being formed by milling away the surface of a section of said cover.

13. A lock assembly as defined in claim 3 wherein said spindle means comprises:

an elongated spindle having a longitudinally extending slot formed in the circumference thereof for receiving therein said spindle key means in sliding relation thereto.

14. A lock assembly as defined in claim 13 wherein said cam wheel means comprises:

a cam wheel having a hollow interior and slot means formed in the side wall of said hollow interior for receiving said spindle key means therein with a sliding fit.

15. A lock assembly as defined in claim 14 wherein said spindle key means comprises:

an elongated key member engageable jointly with said cam wheel means and said spindle means.

* * * * *